US008894062B1

(12) United States Patent
Chen et al.

(10) Patent No.: US 8,894,062 B1
(45) Date of Patent: Nov. 25, 2014

(54) AUTOMATIC PAPER FEED DEVICE

(71) Applicant: Foxlink Image Technology Co., Ltd., New Taipei (TW)

(72) Inventors: Kuan Ting Chen, New Taipei (TW); Wen Ching Liao, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 14/217,992

(22) Filed: Mar. 18, 2014

(51) Int. Cl.

| | |
|---|---|
| ***B65H 3/06*** | (2006.01) |
| ***B65H 1/14*** | (2006.01) |
| ***B65H 1/04*** | (2006.01) |
| ***B65H 7/02*** | (2006.01) |

(52) U.S. Cl.
CPC .. *B65H 1/14* (2013.01); *B65H 1/04* (2013.01); *B65H 7/02* (2013.01)
USPC ..... 271/137; 271/121; 271/126; 271/131; 271/138

(58) Field of Classification Search
USPC ..... 271/137, 121, 126, 131, 138
See application file for complete search history.

(56) References Cited

U.S. PATENT DOCUMENTS

| | | | | |
|---|---|---|---|---|
| 6,367,795 | B1 * | 4/2002 | Matsuda et al. | 271/126 |
| 7,357,386 | B2 * | 4/2008 | Shikan et al. | 271/10.09 |
| 7,392,979 | B2 * | 7/2008 | Sasaki et al. | 271/120 |
| 7,410,161 | B2 * | 8/2008 | Yamamoto | 271/124 |
| 7,621,522 | B2 * | 11/2009 | Yasukawa et al. | 271/121 |

* cited by examiner

*Primary Examiner* — Luis A Gonzalez
(74) *Attorney, Agent, or Firm* — WPAT, P.C.; Anthony King

(57) ABSTRACT

An automatic paper feed device includes a mechanical frame, a paper supply tray mounted to the mechanical frame, at least one motor mounted to one side of the mechanical frame, an upper cover, a stopper mechanism, a paper pressing mechanism, a transmission mechanism, a feed mechanism and a control mechanism. The stopper mechanism includes a blocking element and a torsion spring. The paper pressing mechanism includes a pressing board, at least one pressing roller and an elastic element. The feed mechanism is pivotally mounted to the paper supply tray. The control mechanism controls the motor to rotate, the rotation of the motor drives the transmission mechanism to support or break away from the pressing board to make the pressing board slide upward or downward with respect to the paper supply tray and further abut against or break away from the blocking element.

14 Claims, 13 Drawing Sheets

AUTOMATIC PAPER FEED DEVICE

BACKGROUND OF THE INVENTION

1. Field of the Invention

The present invention generally relates to a paper feed device, and more particularly to an automatic paper feed device capable of feeding paper piece by piece.

2. The Related Art

With the development of science and technology, computer peripheral related affair machines, such as printers, photocopiers, scanners, fax machines and so on, are becoming more and more popular. Overall, each of the printers, the photocopiers, the scanners and the fax machines are equipped with an automatic paper feed device. The automatic paper feed device generally defines a feed channel, and includes a paper supply tray, and a stopper mechanism connected with an inner side of the paper supply tray for ensuring paper to be placed in a proper position of the paper supply tray quickly and neatly. So that effectively avoids causing a picking up defect on account of the paper being placed in an improper position to improve a stability of the automatic paper feed device.

In use, a stack of paper is placed on the paper supply tray and fed into the automatic paper feed device piece by piece. If there is no special device in the automatic paper feed device to prevent the paper from floating, when the subsequent piece of paper is fed into the feed channel of the automatic paper feed device, it's apt to generate a tilt phenomenon on account of an affect of the previous paper being transmitted into the automatic paper feed device. If the paper is thinner, softer or fluffier, the tilt phenomenon of the paper is more obvious, so it's unstable for the automatic paper feed device to feed the paper into the feed channel of the automatic paper feed device. Thus the automatic paper feed device is generally equipped with a paper pressing mechanism and a feed mechanism. The paper pressing mechanism presses against the paper fed by the feed mechanism to clamp the paper between the paper pressing mechanism and the feed mechanism for effectively preventing the paper from generating the tilt phenomenon in the process of the paper being fed into the feed channel of the automatic paper feed device by the feed mechanism.

However, the stopper mechanism and the paper pressing mechanism of the above-mentioned automatic paper feed device generally have complex structure that makes the automatic paper feed device have a complex structure and a higher manufacturing cost.

SUMMARY OF THE INVENTION

An object of the present invention is to provide an automatic paper feed device. The automatic paper feed device includes a mechanical frame, a paper supply tray mounted to the mechanical frame, at least one motor mounted to one side of the mechanical frame, an upper cover, a stopper mechanism, a paper pressing mechanism, a transmission mechanism, a feed mechanism and a control mechanism. The upper cover is disposed above the paper supply tray to cooperate with the paper supply tray by a rear end thereof being pivotally mounted to a rear end of the paper supply tray. The upper cover is covered on the paper supply tray to from an accommodating space located between fronts of the upper cover and the paper supply tray, and a feed channel located between rears of the upper cover and the paper supply tray and communicating with the accommodating space. The stopper mechanism includes a blocking element and a torsion spring.

The blocking element has a first pivoting shaft pivotally mounted to the upper cover, and at least one blocking arm extended downward from a bottom of the first pivoting shaft to project under the upper cover and locate between the accommodating space and the feed channel. The torsion spring is pivotally connected to one end of the first pivoting shaft with one end thereof elastically abutting against the upper cover and the other end thereof elastically abutting against the blocking element. The paper pressing mechanism includes a pressing board, at least one pressing roller and an elastic element. The pressing board is slidably assembled to the upper cover. The pressing roller is pivotally disposed to the pressing board with a bottom thereof projecting under the pressing board. One end of the elastic element elastically abuts against the upper cover and the other end of elastic element elastically abuts against the pressing board. One end of the transmission mechanism is connected with the motor and the other end of the transmission mechanism supports the paper pressing mechanism. The feed mechanism is pivotally mounted to the paper supply tray with a top thereof projecting into the accommodating space. The control mechanism includes a sensor disposed to the upper cover and projecting into the accommodating space. The control mechanism controls the motor to rotate, the rotation of the motor drives the transmission mechanism to support or break away from the pressing board of the paper pressing mechanism to make the pressing board slide upward or downward with respect to the paper supply tray and further abut against or break away from the blocking element of the stopper mechanism.

As described above, the control mechanism controls the motor to rotate to drive the transmission mechanism to support or break away from the pressing board of the paper pressing mechanism to make the pressing board slide upward or downward with respect to the paper supply tray so that the pressing board abuts against or breaks away from the stopper mechanism for making the blocking arm of the blocking element located at the paper blocking position or the blocking arm of the blocking element capable of being pushed rearward by the paper to let the paper fed into the feed channel of the automatic paper feed device. Thus, the stopper mechanism and the paper pressing mechanism of the automatic paper feed device have simple structures so as to make the automatic paper feed device have a simple structure and a lower manufacturing cost.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
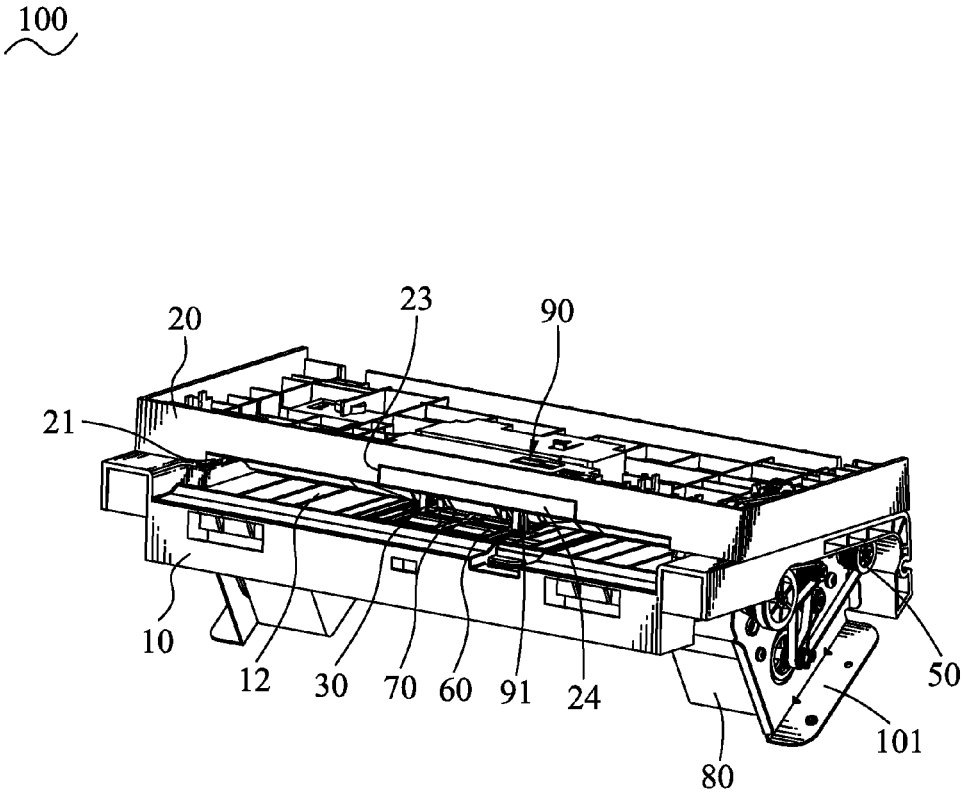
FIG. 1 is a perspective view of an automatic paper feed device in accordance with an embodiment of the present invention.
Figure 2:
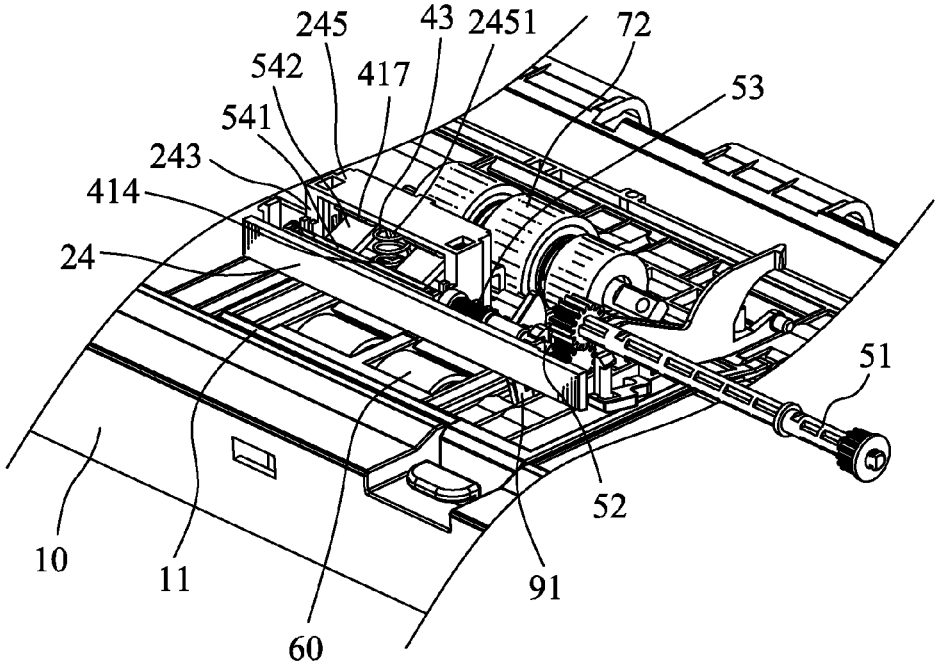
FIG. 2 is a partially perspective view of the automatic paper feed device of FIG. 1, wherein an upper cover of the automatic paper feed device is moved away.
Figure 3:
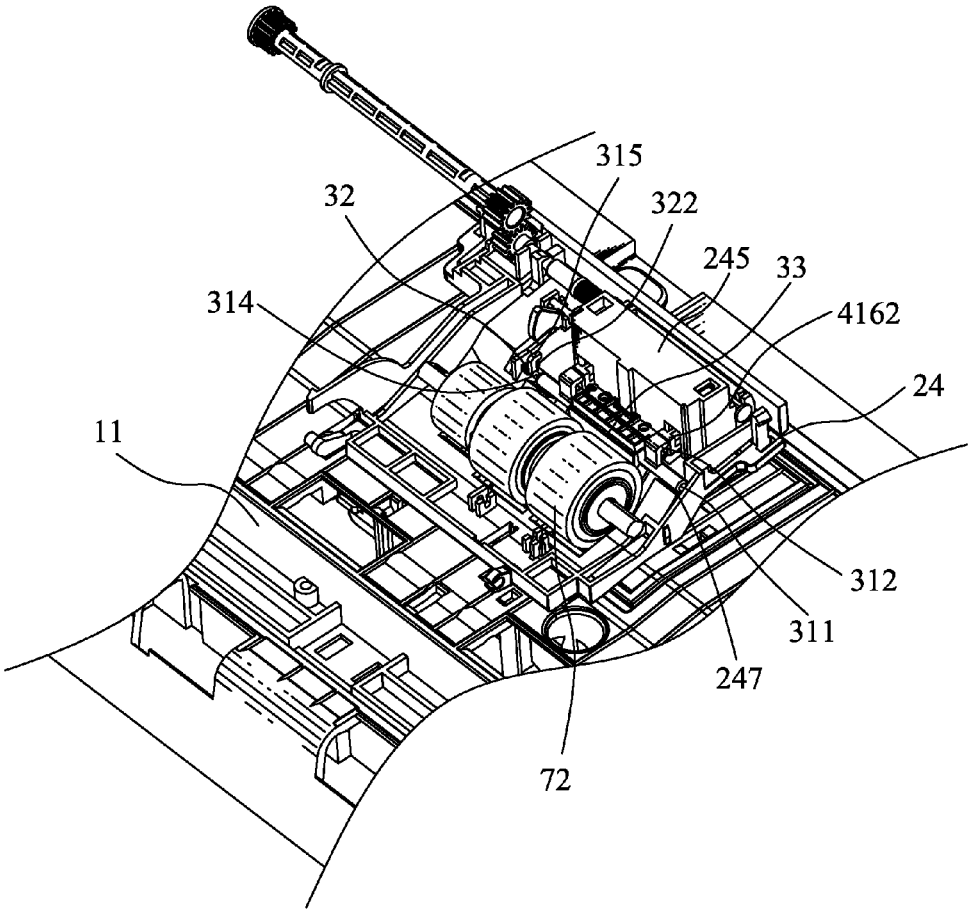
FIG. 3 is another partially perspective view of the automatic paper feed device of FIG. 1, wherein the upper cover of the automatic paper feed device is moved away.
Figure 4:
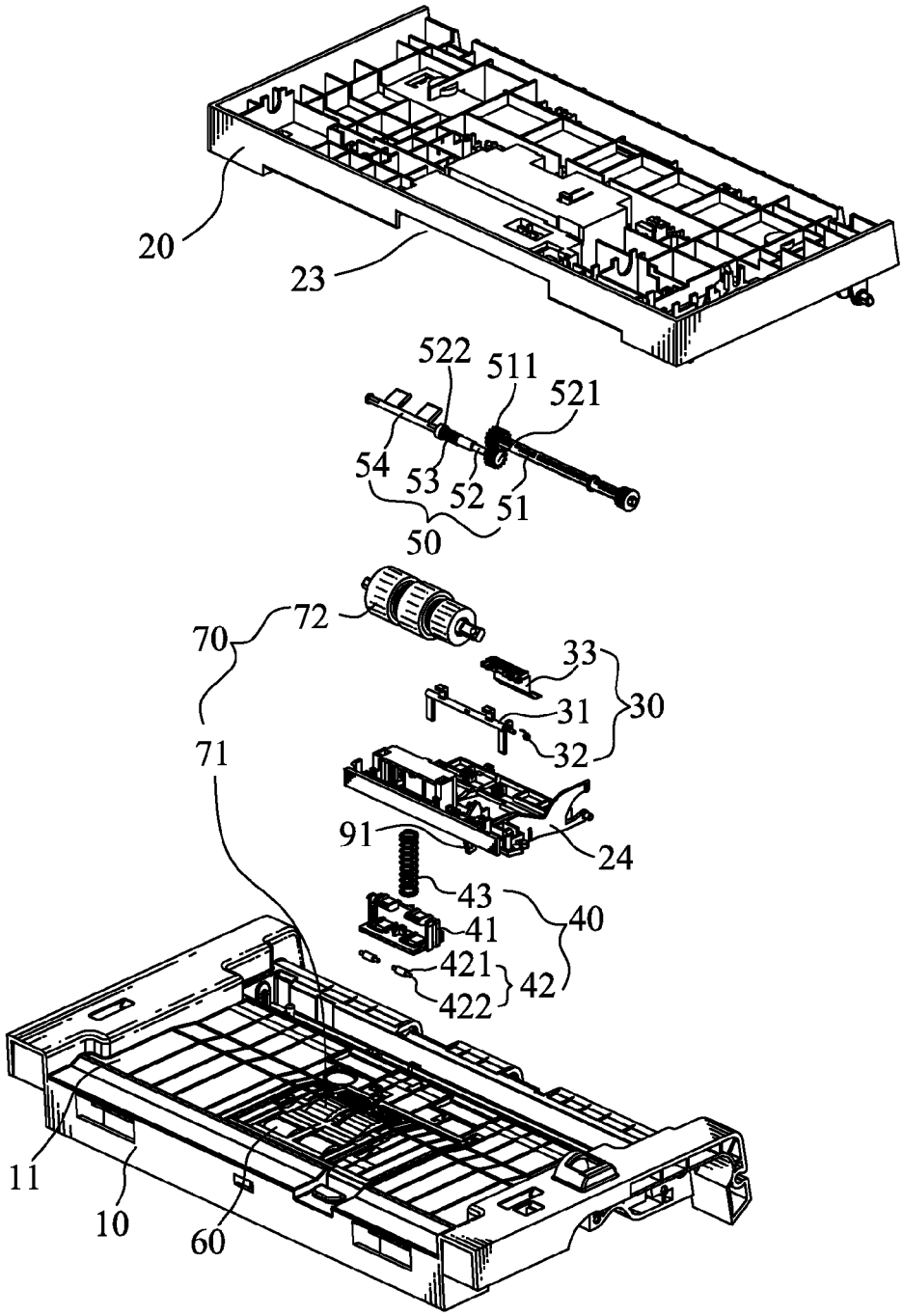
FIG. 4 is a partially exploded view of the automatic paper feed device of FIG. 1.

With reference to FIG. 1 and FIG. 4, an automatic paper feed device 100 in accordance with an embodiment of the present invention is shown. The automatic paper feed device 100 includes a mechanical frame 101, a paper supply tray 10, an upper cover 20, a stopper mechanism 30, a paper pressing mechanism 40, a transmission mechanism 50, a feed mechanism 60, a separation mechanism 70, at least one motor 80 and a control mechanism 90.

Referring to FIG. 1 and FIG. 4, the paper supply tray 10 is mounted to the mechanical frame 101, and the motor 80 is mounted to one side of the mechanical frame 101. A middle of a top of the paper supply tray 10 is concaved downward to form a first opening 11 passing through a front surface and a rear surface thereof.

Referring to FIG. 1, FIG. 3, FIG. 4, FIG. 5 and FIG. 11, the upper cover 20 is disposed above the paper supply tray 10 to cooperate with the paper supply tray 10 by a rear end thereof being pivotally mounted to a rear end of the paper supply tray 10 to make the upper cover 20 rotate upward and downward pivoting the rear end of the paper supply tray 10. The upper cover 20 defines a second opening 21 passing through a middle of a front of a bottom surface thereof and a front surface thereof. The upper cover 20 is covered on the paper supply tray 10 to from an accommodating space 12 located between fronts of the upper cover 20 and the paper supply tray 10, and a feed channel 22 located between rears of the upper cover 20 and the paper supply tray 10 and communicating with the accommodating space 12. Specifically, the first opening 11 integrates with the second opening 21 to form the accommodating space 12. A middle of a front of the upper cover 20 defines an assembling groove 23 passing through the bottom surface and the front surface thereof.

Referring to FIG. 1, FIG. 3, FIG. 4 and FIG. 5, the upper cover 20 includes a fastening housing 24 assembled to the assembling groove 23. The fastening housing 24 of the upper cover 20 defines at least one first through-hole 241. In this embodiment, two opposite sides of the fastening housing 24 of the upper cover 20 define two first through-holes 241. The fastening housing 24 of the upper cover 20 further defines a second through-hole 242 located at one side of the first through-holes 241. A front of a bottom of the fastening housing 24 is recessed inward to form a receiving space 246 which is surrounded by two side walls 243, a rear wall 244 and a top wall 245. An inner surface of each side wall 243 of the receiving space 246 defines at least one first guiding groove 2431. In this embodiment, the inner surface of each side wall 243 of the receiving space 246 defines two first guiding grooves 2431 respectively located in a front thereof and a rear thereof. A bottom of the first guiding groove 2431 located in the front of the inner surface of the corresponding side wall 243 of the receiving space 246 protrudes towards the receiving space 246 to form a clamping strip 2432. Two bottoms of two opposite sides of the rear wall 244 of the receiving space 246 define two third through-holes 2441 communicating with the receiving space 246. A middle of an inner surface of the rear wall 244 of the receiving space 246 defines a second guiding groove 2442. A bottom surface of the top wall 245 of the receiving space 246 protrudes downward to form a first fastening portion 2451 projecting into the receiving space 246. A top surface of the fastening housing 24 of the upper cover 20 is concaved downward to form a pivoting groove 247 extending transversely and located between the two first through-holes 241. The fastening housing 24 defines an insertion groove 248 located in rear of the pivoting groove 247.

Referring to FIG. 3, FIG. 4, FIG. 6, FIG. 7 and FIG. 11, the stopper mechanism 30 includes a blocking element 31, a torsion spring 32 and a restricting board 33. The blocking element 31 of the stopper mechanism 30 has a first pivoting shaft 311, and at least one blocking arm 312 extended downward from a bottom of the first pivoting shaft 311, two inverted L-shaped first limiting portions 313 protruded upward from two opposite sides of a top of the first pivoting shaft 311, a second pivoting shaft 314 transversely protruded outward from one end of the first pivoting shaft 311, and an inverted L-shaped second limiting portion 315 protruded upward from a top of the second pivoting shaft 314. The torsion spring 32 has a first torsion arm 321 and a second torsion arm 322. In this embodiment, the blocking element 31 of the stopper mechanism 30 includes two blocking arms 312 extended downward from two opposite sides of the bottom of the first pivoting shaft 311. The first pivoting shaft 311 of the blocking element 31 of the stopper mechanism 30 is pivotally mounted to the upper cover 20, and the first pivoting shaft 311 of the blocking element 31 of the stopper mechanism 30 is pivoted in the pivoting groove 247. The blocking arm 312 passes through the first through-hole 241 to project under the upper cover 20 and locate between the accommodating space 12 and the feed channel 22. The torsion spring 32 is pivotally connected to one end of the first pivoting shaft 311 of the blocking element 31 with one end thereof elastically abutting against the fastening housing 24 of the upper cover 20 and the other end thereof elastically abutting against the blocking element 31. Specifically, the torsion spring 32 is worn around the second pivoting shaft 314 with the first torsion arm 321 thereof elastically abutting against the fastening housing 24 of the upper cover 20 and the second torsion arm 322 of the torsion spring 32 elastically abutting against the second limiting portion 315. A bottom of the restricting board 33 is inserted into the insertion groove 248, and a top of the restricting board 33 is fastened above the pivoting groove 247 of the fastening housing 24 so as to restrict the blocking element 31 from moving upward.

Figure 5:
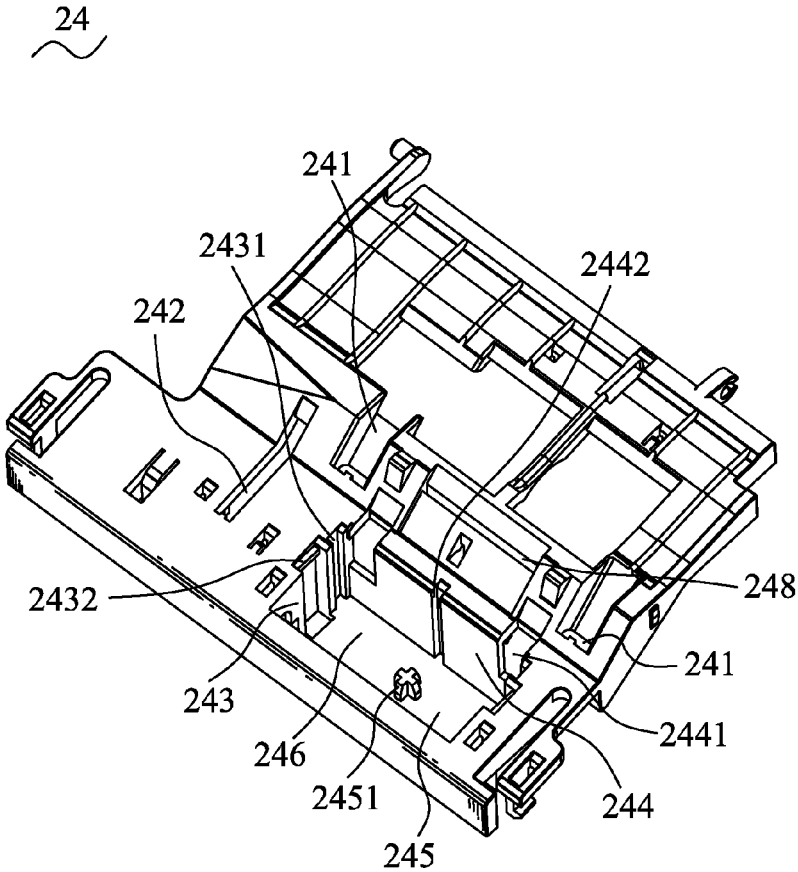
FIG. 5 is a perspective view of a fastening housing of the automatic paper feed device of FIG. 4.
Figure 6:
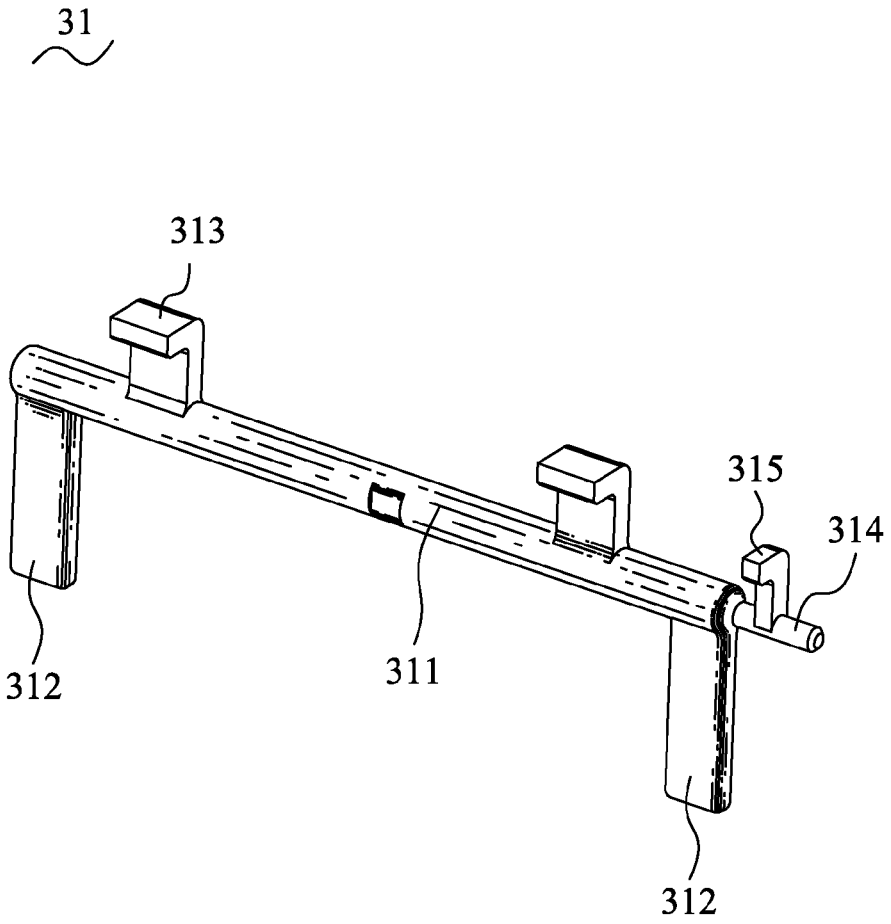
FIG. 6 is a perspective view of a blocking element of the automatic paper feed device of FIG. 4.
Figure 7:
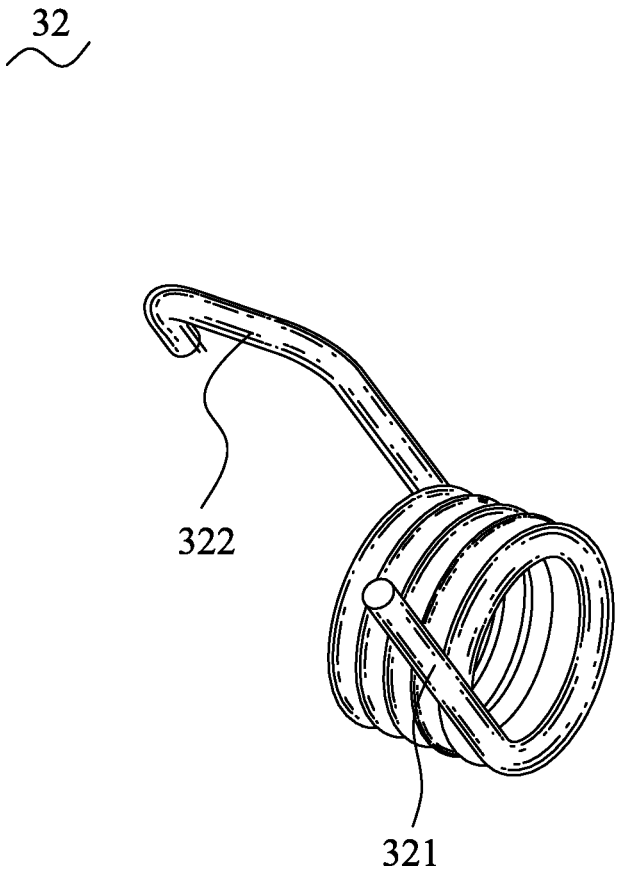
FIG. 7 is a perspective view of a torsion spring of the automatic paper feed device of FIG. 4.
Figure 8:
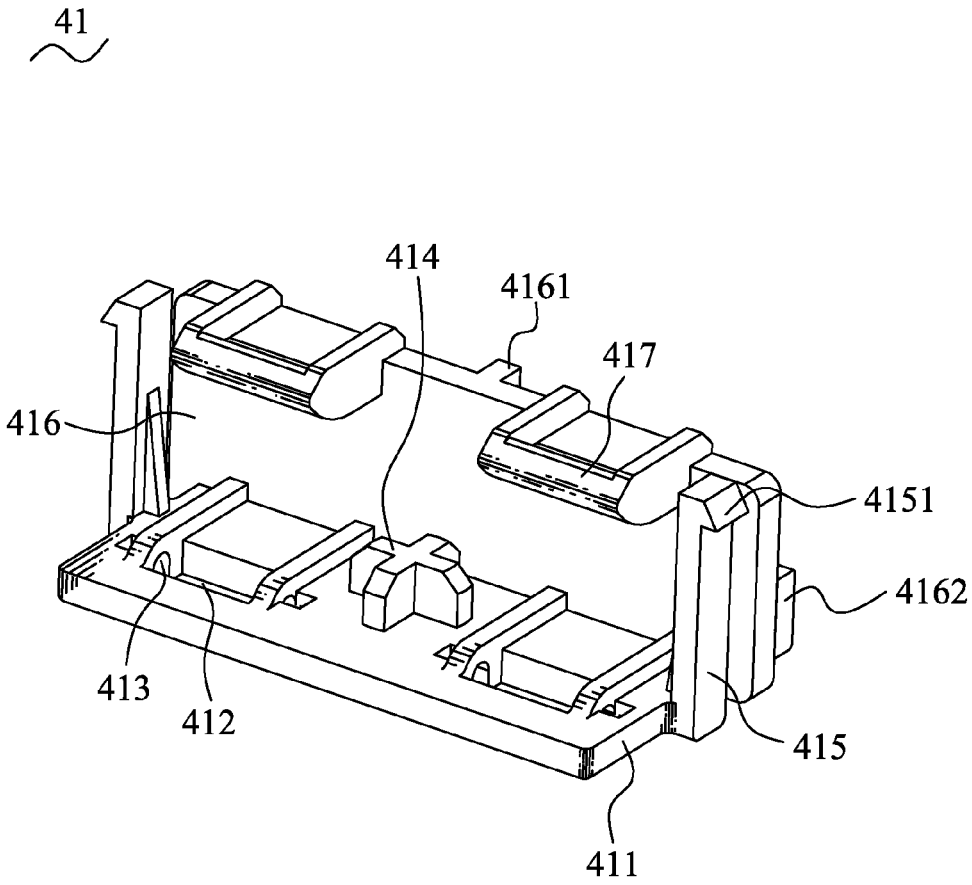
FIG. 8 is a perspective view of a pressing board of the automatic paper feed device of FIG. 4.
Figure 9:
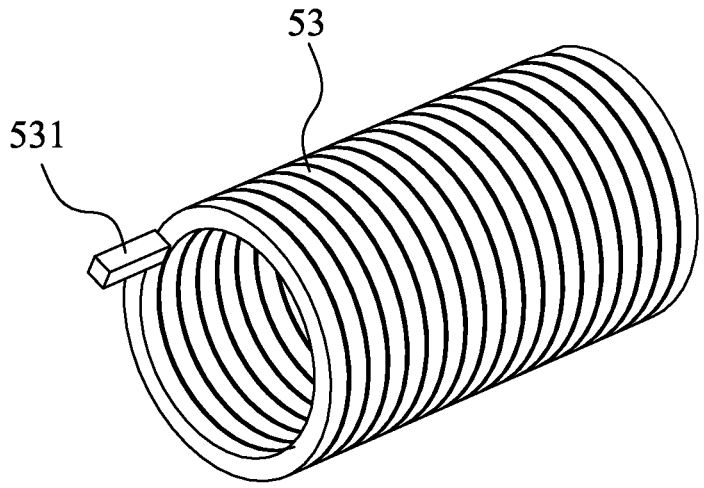
FIG. 9 is a perspective view of a left-hand torsion spring of the automatic paper feed device of FIG. 4.
Figure 10:
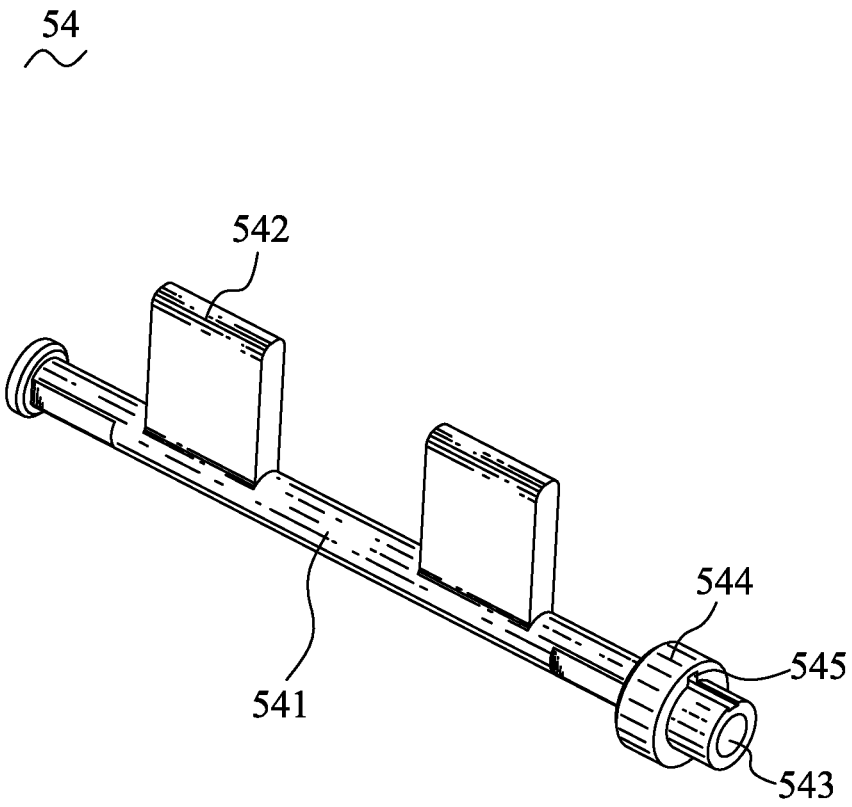
FIG. 10 is a perspective view of a swing arm of the automatic paper feed device of FIG. 4.
Figure 11:
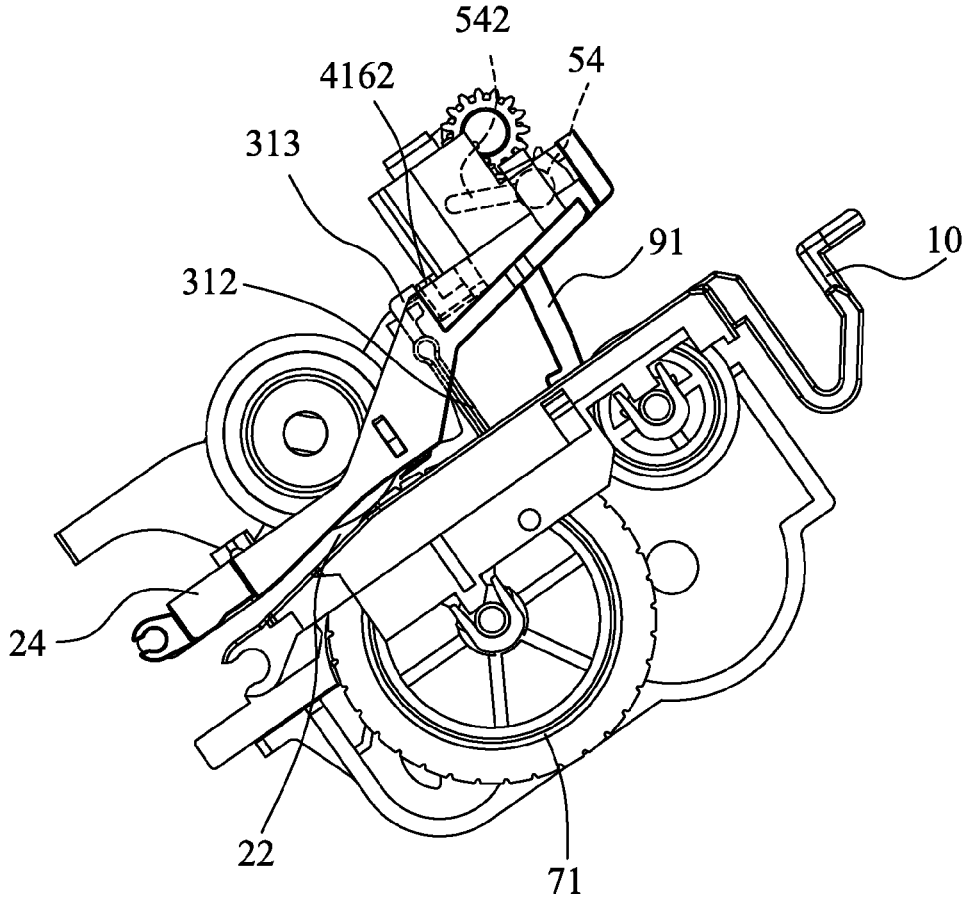
FIG. 11 is a schematic diagram showing an original status of the automatic paper feed device of FIG. 1, wherein no paper is placed in the automatic paper feed device.
Figure 12:
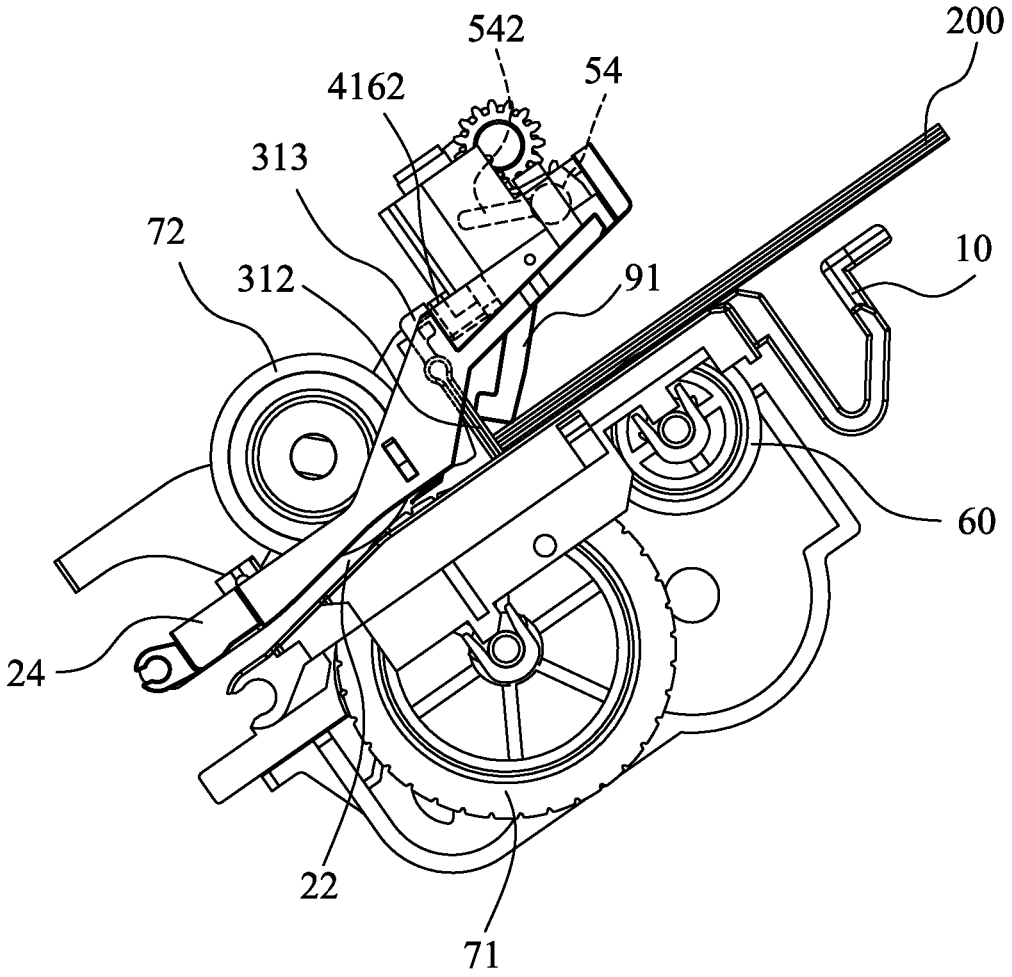
FIG. 12 is a schematic diagram showing a status of the automatic paper feed device of FIG. 1, wherein paper is placed in the automatic paper feed device.
Figure 13:
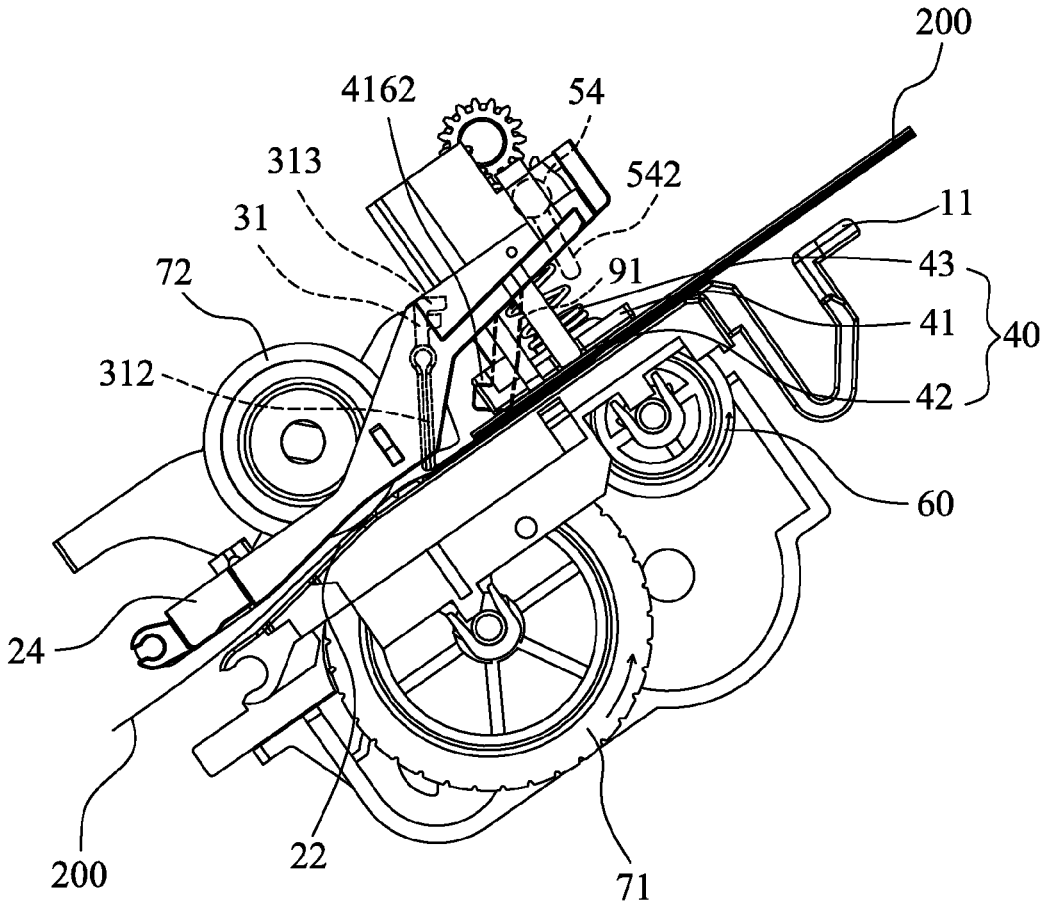
FIG. 13 is a schematic diagram showing another status of the automatic paper feed device of FIG. 1, wherein the paper is fed into the automatic paper feed device.

Referring to FIG. 4, FIG. 5 and FIG. 8, the paper pressing mechanism 40 is slidably assembled to the receiving space 246 of the fastening housing 24 of the upper cover 20, and includes a pressing board 41, at least one pressing roller 42 and an elastic element 43. The pressing board 41 of the paper pressing mechanism 40 is slidably assembled to the receiving space 246 of the upper cover 20. The pressing board 41 of the paper pressing mechanism 40 has a rectangular base board 411, two rectangular first guiding strips 415 extended outward and then extended upward from two opposite side surfaces of the base board 411, and a rear board 416 extended upward from a rear of the base board 411 and projecting beyond the two opposite side surfaces of the base board 411.

The base board 411 transversely defines two rectangular perforations 412 vertically penetrating therethrough and spaced from each other. Two opposite sidewalls of each perforation 412 define two pivoting holes 413. A middle of a top surface of the base board 411 of the pressing board 41 protrudes upward to form a second fastening pillar 414. A free end of the first guiding strip 415 protrudes outward to form a hooking portion 4151. A middle of a rear surface of the rear board 416 protrudes rearward to form a rectangular second guiding strip 4161. A top of a front surface of the rear board 416 protrudes forward to form at least one rectangular supporting board 417. Two lower portions of two opposite sides of a rear surface of the rear board 416 protrude rearward to form two stopper portions 4162. In this embodiment, two portions of the top of the front surface of the rear board 416 of the pressing board 41 of the paper pressing mechanism 40 protrude forward to form two rectangular supporting boards 417 spaced from each other.

Referring to FIG. 2, FIG. 3, FIG. 4, FIG. 5, FIG. 6 and FIG. 8, in this embodiment, the paper pressing mechanism 40 includes two pressing rollers 42. The pressing roller 42 is pivotally disposed to the pressing board 41 with a bottom thereof projecting under the pressing board 41. The pressing roller 42 includes a rolling shaft 421, and two roller portions 422 mounted to two opposite sides of the rolling shaft 421. The two roller portions 422 are pivoted in the two pivoting holes 413. Each rolling shaft 421 is disposed to the perforation 412 with a bottom thereof projecting under a bottom surface of the base board 411. The two first guiding strips 415 and two opposite sides of the rear board 416 are slidably assembled to the first guiding grooves 2431 located in the fronts and the rears of the inner surfaces of the two side walls 243 of the receiving space 246. The first guiding strip 415 is capable of sliding downward until the hooking portion 4151 hooks the clamping strip 2432. So a distance between the hooking portion 4151 and the clamping strip 2432 is designated as the maximum sliding distance of the first guiding strip 415. When the hooking portion 4151 hooks the clamping strip 2432, a bottom surface of the pressing board 41 is adhered to the top surface of the bottom sidewall of the first opening 11 of the paper supply tray 10. The second guiding strip 4161 is slidably received in the second guiding groove 2442. The two stopper portions 4162 are received in the two third through-holes 2441 and further project beyond a rear surface of the rear wall 244 of the receiving space 246. One end of the elastic element 43 is worn around the first fastening portion 2451 and elastically abuts against the top wall 245 of the receiving space 246 of the upper cover 20, and the other end of elastic element 43 is worn around the second fastening pillar 414 and elastically abuts against the base board 411 of the pressing board 41.

Referring to FIG. 2, FIG. 4, FIG. 9 and FIG. 10, one end of the transmission mechanism 50 is connected with the motor 80 and the other end of the transmission mechanism 50 support the paper pressing mechanism 40. The transmission mechanism 50 includes a first rotating shaft 51, a second rotating shaft 52, a left-hand torsion spring 53 and a swing arm 54. One end of the first rotating shaft 51 is equipped with a first gear 511. One end of the second rotating shaft 52 is equipped with a second gear 521. The first gear 511 is engaged with the second gear 521. The other end of the second rotating shaft 52 protrudes outward to form a cylindrical protruding pillar 522. The swing arm 54 has a cylindrical shaft body 541, and at least one rectangular board-shaped arm portion 542 protruded outward from an outer surface of the shaft body 541. In this embodiment, the swing arm 54 of the transmission mechanism 50 has two arm portions 542 protruded outward from the outer surface of the shaft body 541 and spaced from each other. The two arm portions 542 respectively support the two supporting boards 417. One end surface of the shaft body 541 is concaved inward to form a circular locating hole 543. The protruding pillar 522 of the second rotating shaft 52 is located in the locating hole 543. A periphery of the outer surface of the shaft body 541 adjacent to the locating hole 543 protrudes outward to form a ring-shaped clipping portion 544. The outer surface of the shaft body 541 is concaved downward to form a fastening slot 545 extending longitudinally to an inside of the clipping portion 544 and passing through the end surface of the shaft body 541 adjacent to the locating hole 543. One end of the left-hand torsion spring 53 has a third torsion arm 531. The end of the left-hand torsion spring 53 which has the third torsion arm 531 is worn around and fastened to the protruding pillar 522, and located in an outer side of the clipping portion 544, and the other end of the left-hand torsion spring 53 is worn around the shaft body 541. The third torsion arm 531 is fastened in the fastening slot 545 to fasten the end of the left-hand torsion spring 53 which has the third torsion arm 531 to the protruding pillar 522.

Referring to FIG. 1 and FIG. 4, the feed mechanism 60 is pivotally mounted to the paper supply tray 10 with a top thereof projecting beyond the top surface of the bottom sidewall of the first opening 11 and further projecting into the accommodating space 12.

Referring to FIG. 1, FIG. 3, FIG. 4, FIG. 12 and FIG. 13, the separation mechanism 70 includes a separation roller assembly 71 and a retaining roller assembly 72. The separation roller assembly 71 and the retaining roller assembly 72 are respectively disposed at two opposite sides of the feed channel 22 and resist against each other for separating the paper 200 fed by the feed mechanism 60 piece by piece and feeding one piece of paper 200 into the feed channel 22 of the automatic paper feed device 100 each time. Specifically, the separation roller assembly 71 is pivotally mounted to the paper supply tray 10 with a top thereof projecting beyond the top surface of the bottom sidewall of the first opening 11 and further projecting into the feed channel 22. The retaining roller assembly 72 is pivotally mounted to the upper cover 20 with a bottom thereof projecting under the upper cover 20, and further projecting into the feed channel 22 and abutting against the separation roller assembly 71.

Referring to FIG. 1 to FIG. 6, the control mechanism 90 includes a control system (not shown) and a sensor 91. The sensor 91 is disposed to the fastening housing 24 of the upper cover 20 and projects into the accommodating space 12 through the second through-hole 242 of the fastening housing 24 of the upper cover 20 for detecting whether there is any paper 200 on the paper supply tray 10. The control system of the control mechanism 90 controls the motor 80 to rotate, the rotation of the motor drives the arm portion 542 of the swing arm 54 of the transmission mechanism 50 to support or break away from the supporting board 417 of the pressing board 41 of the paper pressing mechanism 40 to make the pressing board 41 slide upward or downward with respect to the paper supply tray 10 and further abut against or break away from the first limiting portions 313 of the blocking element 31 of the stopper mechanism 30. Specifically, the slide of the pressing board 41 drives the stopper portions 4162 of the pressing board 41 to abut against or break away from the first limiting portions 313 of the blocking element 31.

Referring to FIG. 1 to FIG. 13, a working principle of the automatic paper feed device 100 is described as follows.

When the automatic paper feed device 100 is started, the control system of the control mechanism 90 controls the motor 80 to rotate to drive the transmission mechanism 50 to support the pressing board 41 of the paper pressing mechanism 40 to slide upward to an original position. Specifically, the control system of the control mechanism 90 controls the motor 80 to rotate anticlockwise to drive the first rotating shaft 51 of the transmission mechanism 50 to rotate anticlockwise so as to bring along the first gear 511 to rotate anticlockwise, and the first gear 511 is engaged with the second gear 521 to drive the second rotating shaft 52 to rotate clockwise, the second rotating shaft 52 brings along the left-hand torsion spring 53 to twist to generate a torque to drive the shaft body 541 of the swing arm 54 to rotate clockwise. The shaft body 541 rotates clockwise to drive the arm portion 542 of the swing arm 54 to rotate clockwise. The arm portion 542 supports the supporting board 417 to conquer an elastic force of the elastic element 43 to drive the pressing board 41 to slide upward along the first guiding groove 2431 and the second guiding groove 2442 until a top surface of the supporting board 417 abuts against a bottom surface of the top wall 245 of the receiving space 246. The elastic element 43 is compressed to accumulate an elastic potential energy, at the moment, the motor 80 transmits a binding force to the pressing board 41 for conquering an elastic force of the elastic element 43. The stopper portions 4162 of the pressing board 41 abut against the first limiting portions 313 of the blocking element 31, and the pressing board 41 transmits the binding force to the blocking element 31 to make the blocking arm 312 of the blocking element 31 located at a paper blocking position, so the blocking arm 312 of the blocking element 31 has no way to be pushed rearward by the paper 200.

After the initialization is completed, the paper 200 is placed on the paper supply tray 10, and the paper 200 is limited being fed into the feed channel 22 by virtue of the blocking arm 312 of the blocking element 31 to make the paper 200 located in a pickup position. Specifically, when the paper 200 is placed on the paper supply tray 10, the paper 200 touches the sensor 91, the control system of the control mechanism 90 controls the motor 80 to rotate clockwise to drive the first rotating shaft 51 of the transmission mechanism 50 to rotate clockwise to bring along the first gear 511 to rotate clockwise, and the first gear 511 is engaged with the second gear 521 to drive the second rotating shaft 52 to rotate anticlockwise, the left-hand torsion spring 53 releases the elastic potential energy. The shaft body 541 of the swing arm 54 rotates anticlockwise to bring along the arm portion 542 of the swing arm 54 to rotate anticlockwise. The arm portion 542 breaks away from the supporting board 417. The bonding force transmitted to the pressing board 41 by the motor 80 is disappeared. The elastic element 43 elastically pushes downward against the top surface of the base board 411 of the pressing board 41 of the paper pressing mechanism 40. The pressing board 41 slides into the accommodating space 12 to make the roller portion 422 of the pressing roller 42 to press downward on the paper 200 for making the paper 200 located above the feed mechanism 60 and providing a positive force needed by the feed mechanism 60 to pick up the paper 200, at the moment, the pressing board 41 moves downward, and the stopper portions 4162 of the pressing board 41 moves downward, the stopper portions 4162 of the pressing board 41 break away from the first limiting portions 313 of the blocking element 31, and the binding force provided for the blocking element 31 by the pressing board 41 is disappeared to make the blocking arm 312 of the blocking element 31 capable of being pushed rearward by the paper 200 to let the paper 200 fed into the feed channel 22 of the automatic paper feed device 100.

When the paper 200 is fed into the feed channel 22 of the automatic paper feed device 100, the control system of the control mechanism 90 controls the motor 80 to rotate clockwise and drive the feed mechanism 60 and the separation roller assembly 71 to rotate towards a feeding direction, the paper 200 is fed into the feed channel 22 by a force generated between the feed mechanism 60 and the pressing roller 42, when a feed force of the paper 200 is stronger than a torsion force of the torsion spring 32 of the stopper mechanism 30, the feed force of the paper 200 pushes the blocking arm 312 of the stopper mechanism 30 to swing rearward, the torsion spring 32 is compressed and accumulates the torsion force, the paper 200 continues being fed into the feed channel 22, and the paper 200 is fed into the feed channel 22 piece by piece by the separation roller assembly 71 and the retaining roller assembly 72.

When the bottommost paper 200 is completed being fed into the feed channel 22, the blocking element 31 returns to the paper blocking position under an action of a gravity of the blocking arm 312 and the torsion force of the torsion spring 32. When all the actions are completed, the control system of the control mechanism 90 controls the motor 80 to rotate anticlockwise again to drive the first rotating shaft 51 to rotate anticlockwise, the first rotating shaft 51 drives the shaft body 541 to rotate clockwise and bring along the swing arm 54 to rotate clockwise, the arm portion 542 of the swing arm 54 supports the supporting board 417 of the pressing board 41 to conquer the elastic force of the elastic element 43 to move upward to return to the original position.

As described above, the control mechanism 90 controls the motor 80 to rotate to drive the transmission mechanism 50 to support or break away from the pressing board 41 of the paper pressing mechanism 40 to make the pressing board 41 slide upward or downward with respect to the paper supply tray 10 so that the pressing board 41 abuts against or breaks away from the stopper mechanism 30 for making the blocking arm 312 of the blocking element 31 located at the paper blocking position or the blocking arm 312 of the blocking element 31 capable of being pushed rearward by the paper 200 to let the paper 200 fed into the feed channel 22 of the automatic paper feed device 100. Thus, the stopper mechanism 30 and the paper pressing mechanism 40 of the automatic paper feed device 100 have simple structures so as to make the automatic paper feed device 100 have a simple structure and a lower manufacturing cost.

What is claimed is:

1. An automatic paper feed device, comprising:

a mechanical frame;

a paper supply tray mounted to the mechanical frame;

at least one motor mounted to one side of the mechanical frame;

an upper cover disposed above the paper supply tray to cooperate with the paper supply tray by a rear end thereof being pivotally mounted to a rear end of the paper supply tray, the upper cover being covered on the paper supply tray to from an accommodating space located between fronts of the upper cover and the paper supply tray, and a feed channel located between rears of the upper cover and the paper supply tray and communicating with the accommodating space;

a stopper mechanism including a blocking element and a torsion spring, the blocking element having a first pivoting shaft pivotally mounted to the upper cover, and at least one blocking arm extended downward from a bottom of the first pivoting shaft to project under the upper cover and locate between the accommodating space and the feed channel, the torsion spring being pivotally connected to one end of the first pivoting shaft with one end thereof elastically abutting against the upper cover and the other end thereof elastically abutting against the blocking element;

a paper pressing mechanism including a pressing board, at least one pressing roller and an elastic element, the pressing board being slidably assembled to the upper cover, the pressing roller being pivotally disposed to the pressing board with a bottom thereof projecting under the pressing board, one end of the elastic element elastically abutting against the upper cover and the other end of elastic element elastically abutting against the pressing board;

a transmission mechanism, one end of the transmission mechanism being connected with the motor and the other end of the transmission mechanism supporting the paper pressing mechanism;

a feed mechanism pivotally mounted to the paper supply tray with a top thereof projecting into the accommodating space; and a control mechanism including a sensor disposed to the upper cover and projecting into the accommodating space, wherein the control mechanism controls the motor to rotate, the rotation of the motor drives the transmission mechanism to support or break away from the pressing board of the paper pressing mechanism to make the pressing board slide upward or downward with respect to the paper supply tray and further abut against or break away from the blocking element of the stopper mechanism.

2. The automatic paper feed device as claimed in claim 1, wherein a middle of a top of the paper supply tray is concaved downward to form a first opening passing through a front surface and a rear surface thereof, the upper cover defines a second opening passing through a middle of a front of a bottom surface thereof and a front surface thereof, the first opening integrates with the second opening to form the accommodating space.

3. The automatic paper feed device as claimed in claim 1, wherein a front of the upper cover defines an assembling groove passing through a bottom surface and a front surface thereof, the upper cover includes a fastening housing assembled to the assembling groove, a front of a bottom of the fastening housing is recessed inward to form a receiving space which is surrounded by two side walls, a rear wall and a top wall, the pressing board of the paper pressing mechanism is slidably assembled to the receiving space of the upper cover.

4. The automatic paper feed device as claimed in claim 3, wherein the fastening housing of the upper cover defines at least one first through-hole, the blocking arm of the blocking element of the stopper mechanism passes through the first through-hole to project under the upper cover and locate between the accommodating space and the feed channel.

5. The automatic paper feed device as claimed in claim 3, wherein two opposite sides of the fastening housing of the upper cover define two first through-holes, the blocking element of the stopper mechanism includes two blocking arms extended downward from two opposite sides of the bottom of the first pivoting shaft, the blocking arm passes through the first through-hole to project under the upper cover and locate between the accommodating space and the feed channel.

6. The automatic paper feed device as claimed in claim 5, wherein a top surface of the fastening housing of the upper cover is concaved downward to form a pivoting groove extending transversely and located between the two first through-holes, the first pivoting shaft of the blocking element of the stopper mechanism is pivoted in the pivoting groove.

7. The automatic paper feed device as claimed in claim 3, wherein the blocking element of the stopper mechanism has a second pivoting shaft transversely protruded outward from one end of the first pivoting shaft, and an inverted L-shaped second limiting portion protruded upward from a top of the second pivoting shaft, the torsion spring has a first torsion arm and a second torsion arm, the torsion spring is worn around the second pivoting shaft with the first torsion arm thereof elastically abutting against the fastening housing of the upper cover and the second torsion arm thereof elastically abutting against the second limiting portion.

8. The automatic paper feed device as claimed in claim 3, wherein the blocking element of the stopper mechanism has two inverted L-shaped first limiting portions protruded upward from two opposite sides of a top of the first pivoting shaft, two bottoms of two opposite sides of the rear wall of the receiving space define two third through-holes communicating with the receiving space, the pressing board of the paper pressing mechanism has a base board, and a rear board extended upward from a rear of the base board and projecting beyond the two opposite side surfaces of the base board, two lower portions of two opposite sides of a rear surface of the rear board protrude rearward to form two stopper portions, the two stopper portions are received in the two third through-holes and further project beyond a rear surface of the rear wall of the receiving space, the rotation of the motor drives the transmission mechanism to support or break away from the pressing board to make the pressing board slide upward or downward, the slide of the pressing board drives the stopper portions of the pressing board to abut against or break away from the first limiting portions of the blocking element.

9. The automatic paper feed device as claimed in claim 3, wherein an inner surface of each side wall of the receiving space defines two first guiding grooves respectively located in a front thereof and a rear thereof, an inner surface of the rear wall of the receiving space defines a second guiding groove, the pressing board of the paper pressing mechanism has a base board, two first guiding strips extended outward and then extended upward from two opposite side surfaces of the base board, and a rear board extended upward from a rear of the base board and projecting beyond the two opposite side surfaces of the base board, a rear surface of the rear board protrudes rearward to form a second guiding strip, the two first guiding strips and two opposite sides of the rear board are slidably assembled to the first guiding grooves located in the fronts and the rears of the inner surfaces of the two side walls of the receiving space, the second guiding strip is slidably received in the second guiding groove.

10. The automatic paper feed device as claimed in claim 9, wherein a top of a front surface of the rear board of the pressing board protrudes forward to form at least one supporting board, the transmission mechanism includes a swing arm which has a shaft body, and at least one arm portion protruded outward from an outer surface of the shaft body, the control mechanism controls the motor to rotate anticlockwise to drive the shaft body of the swing arm to rotate clockwise, the arm portion supports the supporting board to conquer an elastic force of the elastic element to drive the pressing board to slide upward along the first guiding groove and the second guiding groove until a top surface of the supporting board abuts against a bottom surface of the top wall of the receiving space.

11. The automatic paper feed device as claimed in claim 10, wherein the transmission mechanism includes a first rotating shaft, a second rotating shaft and a left-hand torsion spring, one end of the first rotating shaft is equipped with a first gear, one end of the second rotating shaft is equipped with a second gear, the first gear is engaged with the second gear, the other end of the second rotating shaft protrudes outward to form a protruding pillar, one end surface of the shaft body is concaved inward to form a locating hole, the protruding pillar of the second rotating shaft is located in the locating hole, a periphery of the outer surface of the shaft body adjacent to the locating hole protrudes outward to form a ring-shaped clipping portion, the outer surface of the shaft body is concaved downward to form a fastening slot extending longitudinally to an inside of the clipping portion and passing through the end surface of the shaft body adjacent to the locating hole, one end of the left-hand torsion spring has a third torsion arm, the end of the left-hand torsion spring which has the third torsion arm is worn around and fastened to the protruding pillar, and located in an outer side of the clipping portion, and the other end of the left-hand torsion spring is worn around the shaft body, the third torsion arm is fastened in the fastening slot.

12. The automatic paper feed device as claimed in claim 10, wherein two portions of a top of a front surface of the rear board of the pressing board of the paper pressing mechanism protrude forward to form two supporting boards spaced from each other, the swing arm of the transmission mechanism has two arm portions protruded outward from the outer surface of the shaft body and spaced from each other, the control mechanism controls the motor to rotate to drive the arm portion to support or break away from the supporting board.

13. The automatic paper feed device as claimed in claim 10, wherein a bottom surface of the top wall of the receiving space protrudes downward to form a first fastening portion, a top surface of the base board of the pressing board protrudes upward to form a second fastening pillar, one end of the elastic element is worn around the first fastening portion and elastically abuts against the top wall of the receiving space of the upper cover, and the other end of elastic element is worn around the second fastening pillar and elastically abuts against the base board of the pressing board.

14. The automatic paper feed device as claimed in claim 3, wherein the fastening housing of the upper cover further defines a second through-hole, the sensor is disposed to the fastening housing of the upper cover to project into the accommodating space through the second through-hole of the fastening housing of the upper cover.

* * * * *